US005147179A

United States Patent [19]

Bransch

[11] Patent Number: 5,147,179

[45] Date of Patent: Sep. 15, 1992

[54] TURBINE PUMP WITH MULTISTAGE VENTING OF LUBRICATING FLUID FLOW

[76] Inventor: Edward J. Bransch, 1760 Old Plank Rd., Milford, Mich. 48042

[21] Appl. No.: 447,681

[22] Filed: Dec. 8, 1989

[51] Int. Cl.[5] ..... F01D 25/32

[52] U.S. Cl. ..... 415/168.2; 415/169.1; 417/423.11

[58] Field of Search ..... 415/168.1, 168.2, 902, 415/903, 198.1, 199.1, 199.2, 199.3, 110, 111; 417/435, 423.3, 423.5, 423.11, 424.1; /

[56] References Cited

U.S. PATENT DOCUMENTS

| | | | |
|---|---|---|---|
| 1,155,401 | 10/1915 | Bodinson | 415/199.1 |
| 1,169,266 | 1/1916 | Krogh | 415/168.2 |
| 1,179,346 | 4/1916 | Chapman | 415/199.1 |
| 1,524,073 | 1/1925 | Wintroath | 415/168.2 |
| 2,812,111 | 11/1957 | Wright et al. | 417/423.5 |
| 4,854,834 | 8/1989 | Gschwender et al. | 417/423.11 |
| 4,877,371 | 10/1989 | Putt | 415/214.1 |

FOREIGN PATENT DOCUMENTS

| | | | |
|---|---|---|---|
| 2750801 | 5/1979 | Fed. Rep. of Germany | 415/168.2 |
| 682670 | 8/1979 | U.S.S.R. | 415/168.2 |

*Primary Examiner*—John T. Kwon
*Attorney, Agent, or Firm*—John R. Benefiel

[57] ABSTRACT

A vertical turbine pump of the type including a diversion of flow of pumped fluid to lubricate shaft bearings in the pumping section, in which a venting of the lubricating flow to the tank is carried out in a multiple stage venting through successive vent pipes in a vertical series of vent housing sections installed above the pumping section. A cascade venting flow thereof is enabled to insure that a pressure build up at a point of venting is occurred, eliminating the need for mechanical sealing of the drive shaft for high pressure systems.

6 Claims, 4 Drawing Sheets

TURBINE PUMP WITH MULTISTAGE VENTING OF LUBRICATING FLUID FLOW

This invention concerns pumps and more particularly high pressure turbine pumps utilizing a diverted small portion of the flow of pumped liquid to lubricate the bearings supporting the impeller drive shaft in the pump housing.

Turbine pumps are often designed to avoid the need for oil or grease lubricating bearings within the flow of working fluid at points where high pressure conditions exist by establishing a flow of the liquid pumped through the bearing clearance to act as a lubricant. This approach also establishes a hydrodynamic bearing which performs well in this environment.

In these pumps, the pumped liquid passes out at a turned discharge head, and the impeller drive shaft passes through the pump casing to the electric drive motor.

By using high pressure working liquid as a lubricant, an arrangement is required to prevent the escape of working liquid at the point where the drive shaft passes out of the pump casing.

There has heretofore been developed a system in which the lubricating flow is intercepted and vented through a cross tube in the pump casing. A sealed enclosing tube surrounds the drive shaft above the vent to obviate the need for a running seal at the point the drive shaft exits the casing.

Such bearing lube flow venting arrangement has been widely employed successfully. However, where very high pressures are encountered the arrangement has not worked successfully since the vent has insufficient porting area to relieve the pressure caused by the flow of working fluid used as a lubricant. This is particularly so after wear and increased clearances increase the proportion of the flow of working liquid diverted for lubrication. The consequent pressurized condition at the vent requires sealing of the shaft and leakage typically will flow into the sleeve if the seal fails. Such seals are very costly for typical applications, and have proved to have a short life, necessitating a too frequent need for costly repairs.

The venting cross tube occupies a portion of the space in the pump casing through which the pumped liquid flows, and hence it is not feasible to simply increase the size of the cross tube as this would reduce the area available for the main flow of the pumped fluid.

SUMMARY OF THE INVENTION

The present invention comprises an improved venting arrangement for working fluid used as a lubricant in vertical turbine pumps. This arrangement comprises a multistage venting in which a vertical series of pump case housings are stacked atop each other. Each housing is provided with a respective cross tube receiving lubricant flow from the preceding housing, such that a cascade venting flow is achieved, in the aggregate sufficient to completely vent the lubricant flow even for very high pressure applications, without reducing the primary flow of working fluid. This eliminates the need for high pressure shaft seals and the maintainance entailed thereby, greatly reducing the costs associated with high pressure vertical turbine pumps.

The housings may be separate and assembled together in sufficient numbers to achieve complete venting for the pressures encountered in a given installation.

Alternatively, a one piece casting of a series of housing sections could be employed.

Each housing section contains a shaft bearing which extends into the next succeeding housing, sealed to isolate the lubricating flow from the primary flow of working liquid.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
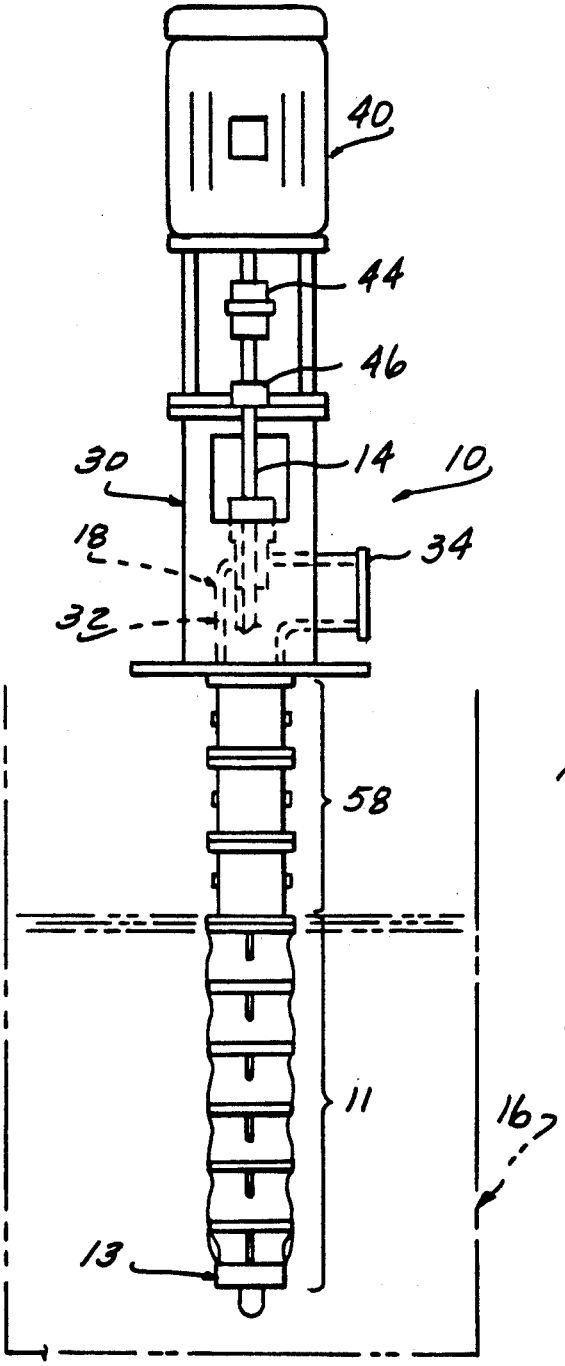
FIG. 1 is a side elevational view of a vertical turbine pump according to the present invention.
Figure 2:
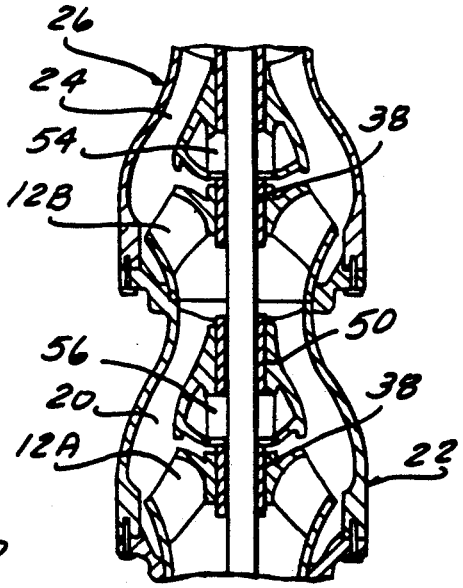
FIG. 2 is a fragmentary side elevational view in partial section of the pumping section of the vertical turbine pump shown in FIG. 1.
Figure 3:
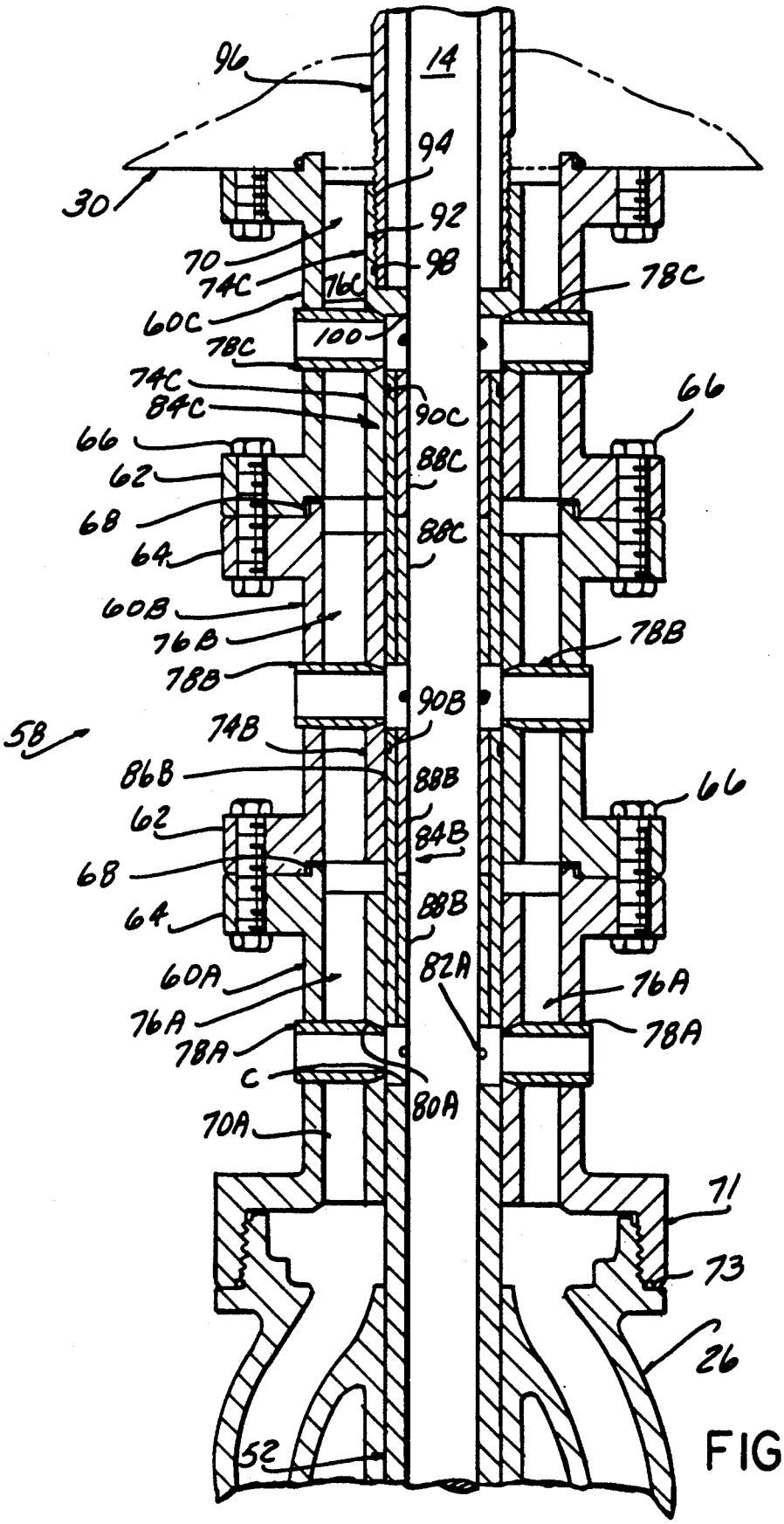
FIG. 3 is an enlarged sectional view of the multistage vent housing sections.

Referring to FIGS. 1 and 2, a vertical turbine pump 10 is depicted, having a plurality of impellers including 12A, 12B (FIG. 2) each secured to a drive shaft 14. The pumping section 11 includes impellers 12A, 12B, etc., which are conventional in design, rotation thereof causing an inflow of liquid contained in the tank 16 in which the pump 10 is submerged through a suction case 13. The liquid is then directed by the first stage impeller 12A through an annular passage 20 defined in a first impeller casing section 22. The annular passage 20 converges to the inlet side of the second stage impeller 12B which directs the flow to an annular flow passage 24 defined in a second impeller casing section 26, and thence through each successive impeller stage to a vent housing section 58, and a discharge head 30. Discharge head 30 includes a discharge casing 32 connected via a flange 34 to the system (not shown) to be supplied with the pumped liquid including a pumping section 11 submerged in an tank 16.

The impeller drive shaft 14 may be supported in a lower or tail bearing (not shown) sealed to keep liquid from entering the bearing, and which may be grease or oil lubricated, in a manner well known in the art.

Each of the impellers 12A and 12B, etc. are fixed to the drive shaft 14 by collets 38 so as to be rotated therewith when the output shaft of drive motor 40 rotates the drive shaft 14 since joined thereto by coupling 44. A suitable ball or roller thrust bearing assembly 46 absorbs the major portion of the loads borne by the drive shaft 14.

The drive shaft 14 is supported by pumping section bearings 50 and 52, typically of the hard bronze type which are supplied with pumped liquid via cavities 54, 56, such that a steady flow of the pumped liquid is established through clearances between the bearing 50, 52 and shaft 14 to lubricate these bearings.

According to the concept of the present invention, a multistage or cascaded venting of this lubricating flow occurs in the vent section 58 of the pump casing.

Figure 4:
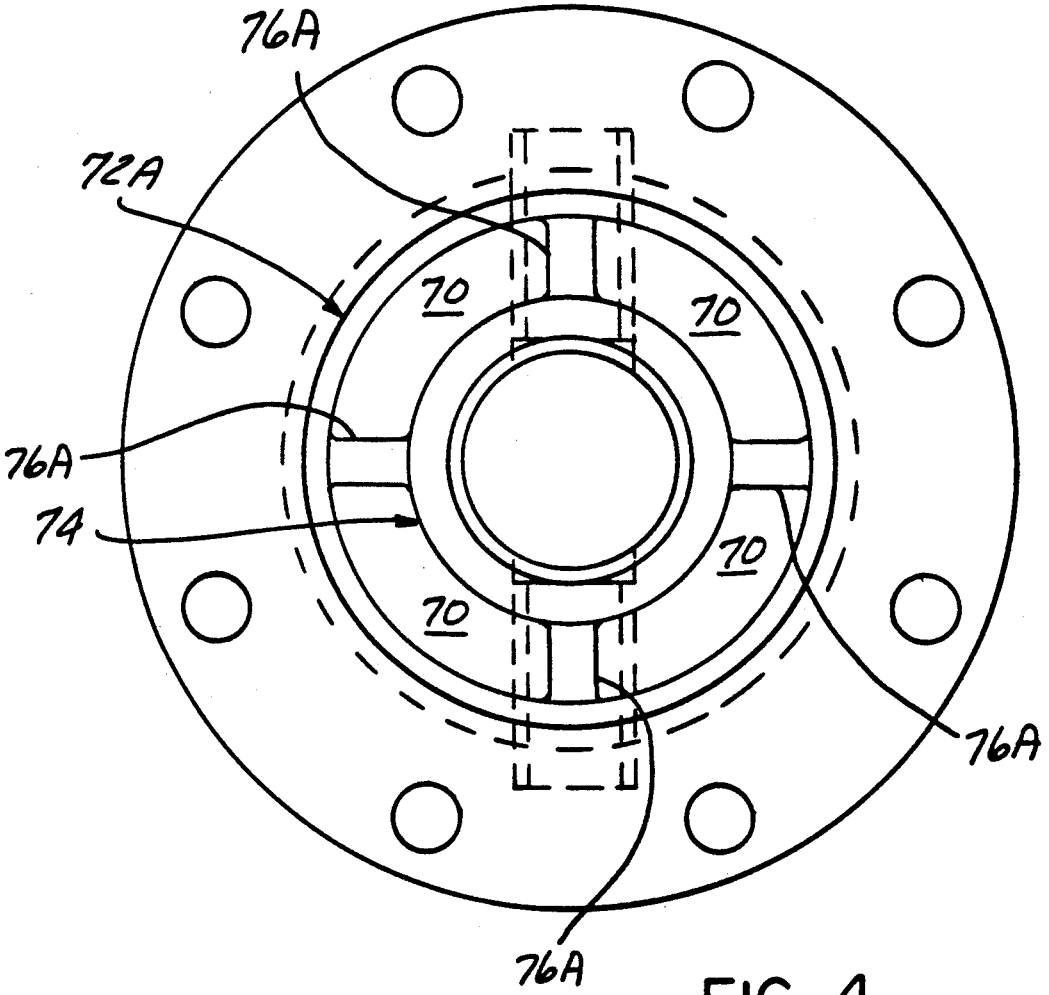
FIG. 4 is an end view of a vent housing assembly.

The vent section 58 is formed of a stacked series of housing assemblies 60A, 60B, 60C secured together as by mating flanges 62, 64, and suitable threaded fasteners 66. O-ring seals 68 prevent leakage of pumped liquid at the joints. The first housing 60A is secured to the uppermost pump case 26 by an internally threaded entrance portion 71 sealed with an O-ring 73. The pumped liquid passing through annular spaces 70A defined between an outer tubular wall 72A and center bearing tube 74 joined together by webs 76A (FIG. 4) welded to each of these components.

The upper most pumping section bearing 52 extends upwardly to be received within the lower half of the center bearing tube 74A, machined to the I.D. of center bearing tube 74A, to press fit the bearing 52 therein to establish a sealed connection.

Installed intermediate the first vent housing 60A are oppositely extending vent pipes 78A, each pressed into a tapered bore 80A and welded about its protruding perimeter to the outside of the tubular wall 72A.

The lubricating flow of pumped liquid exiting the clearance space "C" thus may escape by passing into the interior of each pipe 78A and returned to the tank 16. An O-ring 82A installed on the drive shaft 14 serves to deflect the flow of liquid into the vent pipes 78A.

According to the concept of the present invention, a cascade venting is provided in the second and third housings 60B, 60C, or such additional housings as may be required for given pressure conditions, to insure complete venting and avoid any pressure build up of lubricating liquid for the bearings 50, 52.

Additional bearings 84B, 84C are provided, the shaft 14 passing therethrough. The bearings 84B, 84C function as flow restrictors to limit flow from the first stage vent pipes 78A in the event significant pressure build up occurs due to increased wear in the bearings 52. These bearings are designed to run either lubricated or unlubricated, since the presence of liquid flow will depend on the pressure conditions at each set of vent pipe 78A, 78B, 78C, which in turn will depend on the wear conditions of the bearings below.

Thus, the bearings 84B, 84C are constructed of steel sleeves 86B, 86C with carbon liners 88B, 88C.

The sleeves 86B, 86C are each press fit into the upper half of the respective housings 60A, 60B and are assembled into the lower half of the housings 60B, 60C with slip fit 0-ring seals 90B, 90C are provided to seal the same.

The uppermost housing assembly 60C includes a bearing center tube 74C which has an upper portion 92 internally threaded at 94 to receive an enclosing sleeve 96, sealed with an O-ring 98. An inwardly turned rim 100 forms a close running fit with the shaft 14 just above the uppermost vent pipes 78C.

Thus, if an excessive pressure build up occurs at first vent pipes 78A due to blockage or to wear induced increased clearance past the upper bearing 52, flow past the bearing 84B will allow venting of the liquid through the second set of vent pipes 78B. If continued wear cause a pressure build up at the second set of vent pipes 78B, flow past the second bearing 84C will allow venting through the third set of vent pipes 78C, so that no gage pressure will normally exist at the point the shaft 14 passes into the sleeve 96.

Thus there is no requirement of a mechanical seal for the drive shaft 14 at the discharge head.

Additional vent housing assemblies 60 may be added as required for the particular application to insure complete dissipation of the lubricating flow of process liquid.

Figure 5:
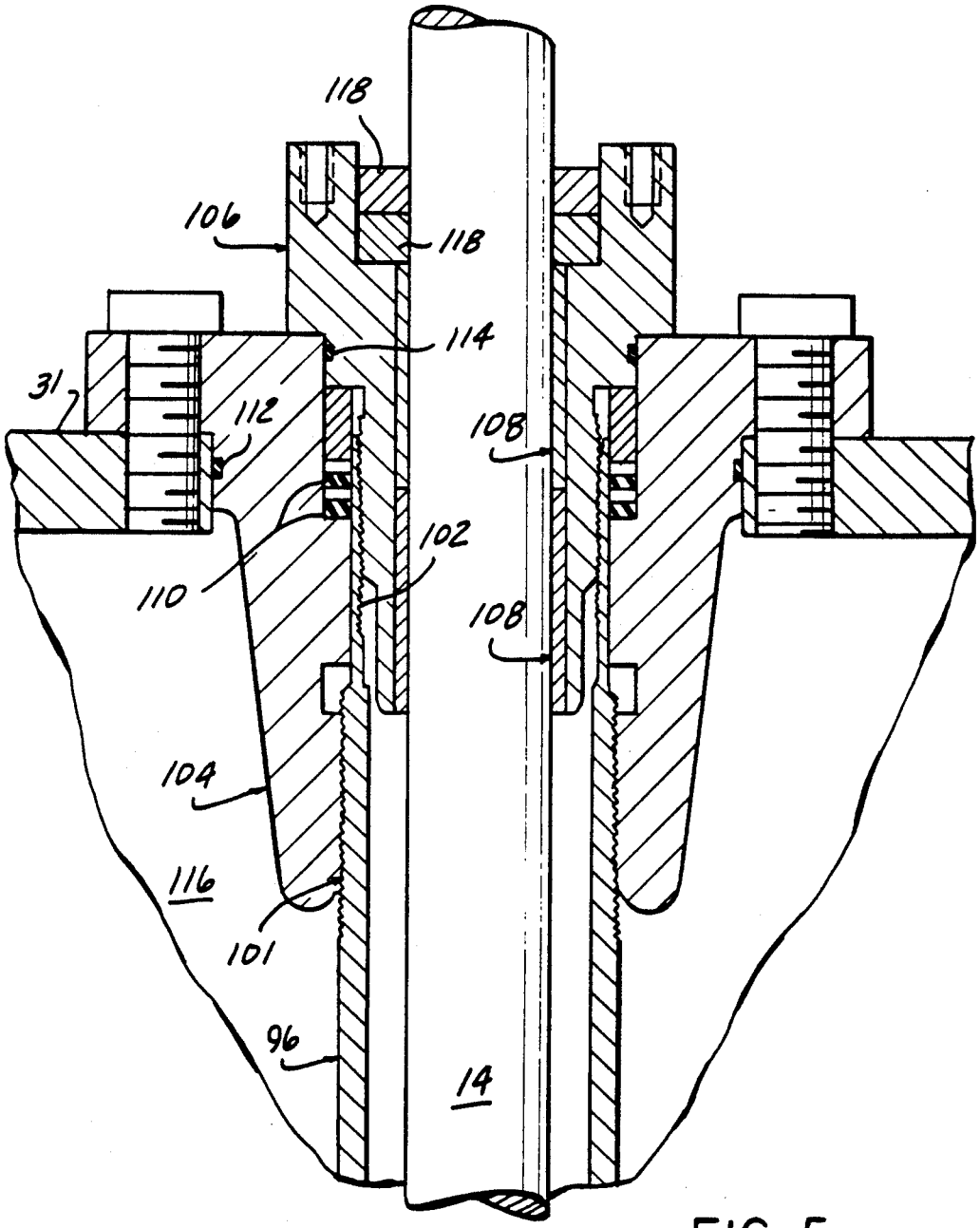
FIG. 5 is a fragmentary view of the upper end of the enclosing sleeve shown in FIG. 3.

Referring to FIG. 5, the upper end of the enclosing sleeve tube 96 is threaded externally at 101 and internally at 102, with a tension plate 104 threadedly engaging the external threads 101 and a tension nut 106 threadedly engaging the internal threads 102 which may be advanced so as to place the sleeve 96 in tension to be stablized.

Carbon bearings 108 locate the shaft 14 within the tension nut 106.

Seals 110, 112, and 114 prevent the escape of pumped liquid from the discharge head cavity 116.

Packing rings 118 and a split gland seal (not shown) may be provided to prevent any liquid which may get into the enclosing sleeve 96 as in an advanced case of bearing wear. When such leakage begins to occur, it will be an indication, together with reduced primary flow, that bearing maintainence is due.

Thus, multiple stage venting is enabled. In many applications, the cascade venting action will occur successively, since venting through the second or third (or fourth, and so on) cross pipes will only occur after bearing wear has allowed a substantial increase in lubricating flow such as to cause an increase in pressure at the prior point of venting of lubricating flow.

In other situations, the degree of pressure may be sufficient to cause some venting at upstream venting pipes even before substantial bearing wear has occurred.

In either event, the multiple venting sections insure that high pressure conditions will not develop at points above the venting sections.

It is also noted that the vent pipes are preferably located above the level of liquid in the tank, and it may be necessary to install separate casing sections between the pumping section and the venting section to locate these vents above the liquid level. Similarly, such extensions may be required above the venting sections.

I claim:

1. A vertical turbine pump having a pumping section including an impeller casing containing one or more impellers, a central drive shaft affixed to said one or more impellers, at least one bearing guiding said drive shaft in said impeller casing, motor drive means for rotating said drive shaft and one or more impellers to cause pumping of fluid upward in said impeller casing, a discharge casing including a horizontally turned fitting receiving the flow of fluid pumped up in said impeller casing and directing said flow to a system, said drive shaft extending up and through a wall of said discharge casing to said drive motor located above said discharge casing, a stationary enclosing sleeve located surrounding said drive shaft and passing through said discharge casing, said enclosing sleeve sealed against the entrance of pumped fluid, the improvement comprising:

a vertical series of venting housing sections surrounding said drive shaft and located above said pumping section, each of said venting housing sections including an outer wall and an inner center bearing tube connected together with a space therebetween, said space receiving said flow of pumped fluid, a bearing within said center bearing tube receiving said drive shaft, with a clearance space therebetween, said clearance space receiving lubricating flow through said at least one bearing in said pumping section, at least one venting pipe mounted in each venting housing section extending through said outer wall and said center bearing tube of each venting housing sections to receive said lubricating flow and direct said flow out of said casing to be vented, whereby a successive cascading of venting flow at each housing sections is enabled.

2. The vertical turbine pump according to claim 1 wherein at least three venting housing sections are included in said vertical series of venting housing sections.

3. The vertical turbine pump according to claim 1 wherein one of said at least one bearing in said pumping section extends vertically up from said pumping section and is fit within the center bearing tube of the first one of said plurality of venting housing sections.

4. The vertical turbine pump according to claim 1 wherein each of the bearings in said center bearing tube of said venting housing above the first section is configured to run unlubricated, in the event said lubricating flow is entirely vented at said first housing.

5. The vertical turbine pump according to claim 1 wherein at least one of said bearings in said center bearing tubes of said venting housing sections includes a bottom portion press fit into the upper half portion of the center bearing tube of a lower venting housing section and extending up within the lower half of the center bearing tube of the next above venting housing section with a slip fit therein, and further including sealing means acting between said slip fit portion thereof and the center lower half portion of the bearing tube of the next above venting housing section.

6. In a vertical turbine pump, a method of venting the flow of lubricating liquid directed within one or more bearings guiding a drive shaft fixed to one or more impellers in a pumping section of said pump, comprising the step of directing said venting flow successively to a plurality of venting pipes each vertically spaced above each other through intermediate bearings clearances surrounding said shaft, whereby a cascade venting flow of said lubricating flow is enabled to insure that a high pressure build up at a venting point will not occur so that mechanical sealing of the drive shaft is not needed.

* * * * *